US006044979A

United States Patent [19]

Rohr et al.

[11] Patent Number: 6,044,979

[45] Date of Patent: Apr. 4, 2000

[54] DEVICE FOR SEPARATING SUPERFINE MATERIAL FROM CONTINUOUSLY FED GRANULAR SOLIDS

[75] Inventors: Wolfgang Rohr, Waldsee; Klaus Bleh, Rödersheim, both of Germany

[73] Assignee: Wolfgang Rohr, Waldsee, Germany

[21] Appl. No.: 09/145,627

[22] Filed: Sep. 2, 1998

[30] Foreign Application Priority Data

Sep. 4, 1997 [DE] Germany ..... 197 38 674

[51] Int. Cl.[7] ..... B03B 5/08

[52] U.S. Cl. ..... 209/430

[58] Field of Search ..... 209/428–433, 209/920

[56] References Cited

U.S. PATENT DOCUMENTS

| | | | |
|---|---|---|---|
| 702,541 | 6/1902 | Cohen et al. | 209/430 |
| 1,030,427 | 6/1912 | Pinder | 209/433 |
| 2,612,267 | 9/1952 | Vogel | 209/428 X |
| 2,825,462 | 3/1958 | Hackney et al. | 209/430 |

FOREIGN PATENT DOCUMENTS

| | | |
|---|---|---|
| 1 884 302 | 12/1963 | Austria . |
| 659 287 | 4/1938 | Germany . |
| 3839666 C1 | 2/1990 | Germany . |

*Primary Examiner*—David H. Bollinger
*Attorney, Agent, or Firm*—Collard & Roe, PC

[57] ABSTRACT

A device for classifying superfine material from continuously fed granular solids which has a charging chute feeding the material into a washing trough. The washing trough is formed by a conveyor belt, which is mounted on a machine frame. A part of the conveyor belt forms the washing trough downstream of the charging chute. Another part of the conveyor belt is arranged below the charging chute, and is elevated against the direction of flow of the charged material. The charging chute has a false bottom above the washing trough and in the material feed area. The false bottom is adjoined by a gap on the head end of the washing trough. The gap extends over the entire width of the trough. The remaining area of the charging chute is perforated. In another embodiment, a vat is arranged at the end of the washing trough and extends over the entire width and depth of the washing trough. The vat has a flow of liquid passing over it and is filled with spherical elements of different shapes, sizes and surfaces.

10 Claims, 9 Drawing Sheets

DEVICE FOR SEPARATING SUPERFINE MATERIAL FROM CONTINUOUSLY FED GRANULAR SOLIDS

BACKGROUND OF THE INVENTION

1. Field of the Invention

The present invention relates to a device for separating superfine material from continuously fed granular solids. More particularly, the invention relates to such a device having a charging chute for feeding the material into a washing trough with showers for washing liquid, and consisting of an endless conveyor beit supported on support rollers and guide rollers, The rollers are mounted on the machine frame so that part of the conveyor belt is arranged downstream of the charging chute and serves as the washing trough, and the other part of the conveyor belt is underneath the charging chute and is ramped up against the direction of flow of the material charged. The conveyor belt is driven against the direction of flow of the material.

2. The Prior Art

A device for washing out organic and clay-like impurities from continuously fed coarsely and finely granular solids is shown in German Patent Application No. DE 38 39 666 C1. With this known device, the material is directly charged into the washing trough via a charging chute. The washing trough is followed by a settling section, the function of which is to hold back gravel grain and sand, so that they are not flushed out with the impurities.

The substantial drawback of this known device is that feeding the material into the washing trough causes a turbulent flow to prevail in the separation bed. This flow interferes with the settling process because the settling material is again stirred up. This does not lead to any maximum separation, i.e., to a grain size of about 0.5 mm for the superfine material to be recovered. Another drawback is that large amounts of process water are required.

SUMMARY OF THE INVENTION

It is therefore an object of the present invention to design a device of the type specified above so that superfine material of the smallest grain size can be separated.

This object is accomplished by providing the bottom of the charging chute above the washing trough and within the area of the material feed with a false bottom or floor, which is adjoined by a gap on the head part of the washing trough. This gap extends across the entire width of the washing trough. The remaining part of the bottom of the charging chute is perforated.

In an alternative embodiment, there is a vat extending across the entire width and depth of the washing trough at the end of the trough. A flow of liquid passes by the vat, which is filled with spherical elements.

Preferably, the height and position of the chute relative to the washing trough, as well as its incline are adjustable. Furthermore, the charging chute is designed either static or dynamic, i.e., equipped with a motor vibrating the chute. Preferably, the spherical elements are of different sizes, weights or surfaces.

The vat is preferably adjustable with respect to its height, inclination and longitudinal direction. There is an adjustable separation paddle arranged on the outlet for the superfine material for dividing the draining suspension in two film or laminar flows.

In an alternative embodiment, there is at least one knocking or striking roller on the conveyor belt within the area of the washing trough. Preferably, the surface of the conveyor belt coming into contact with the charged material has a degree of roughness.

The invention provides the substantial advantage in that by distributing in a controlled manner into the separation bed, the superfine material can be recovered even from suspensions of from 0 to 4 mm, whereby grain sizes of at least 80 mm are achievable. By automatically acquiring the variables of the process, namely through sample taking and subsequently controlling the machine accordingly, it is possible to achieve a uniform band of grain, i.e., grain composition.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
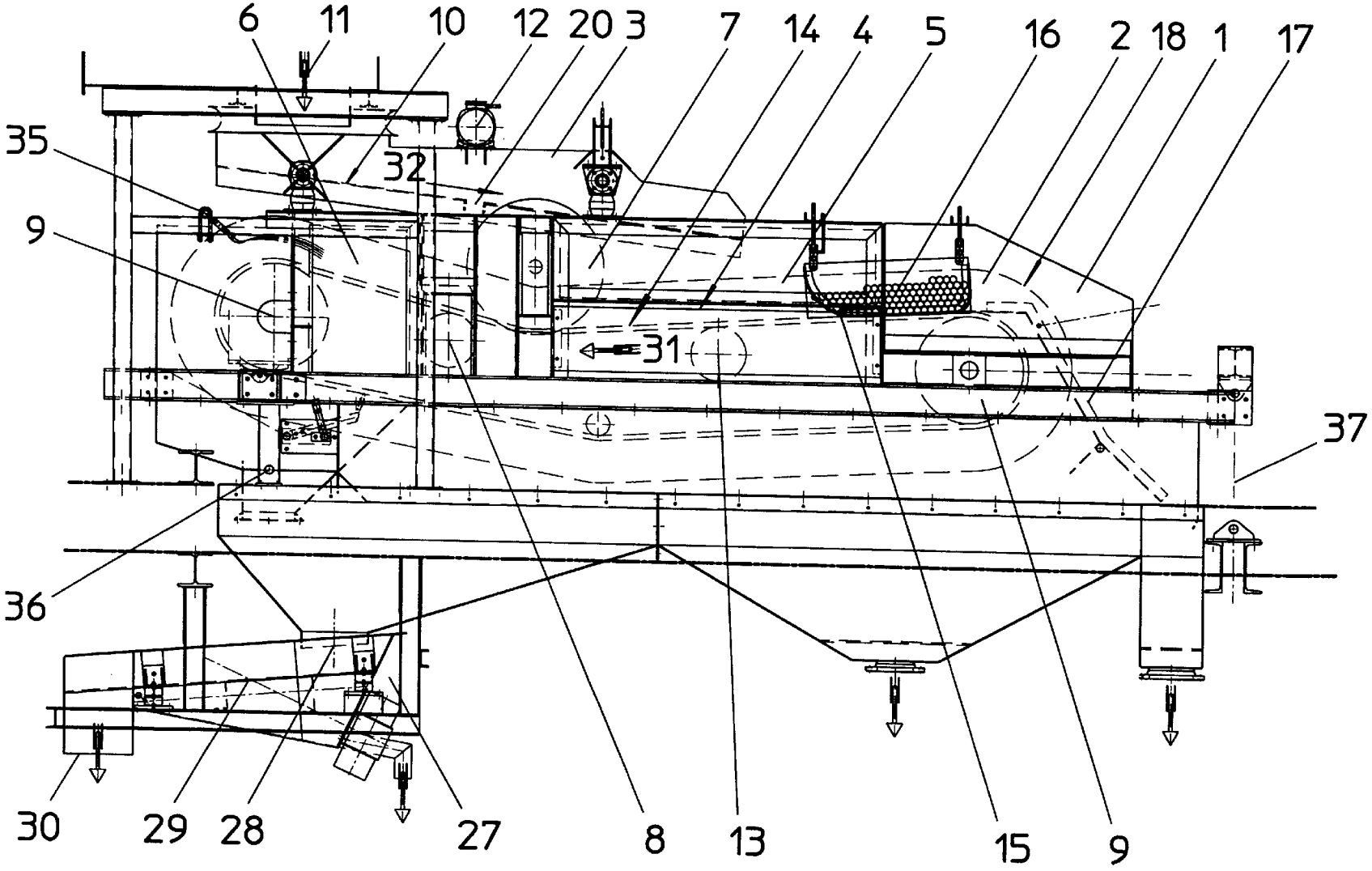
FIG. 1 shows a front view of a first embodiment of the device as defined by the invention.
Figure 2:
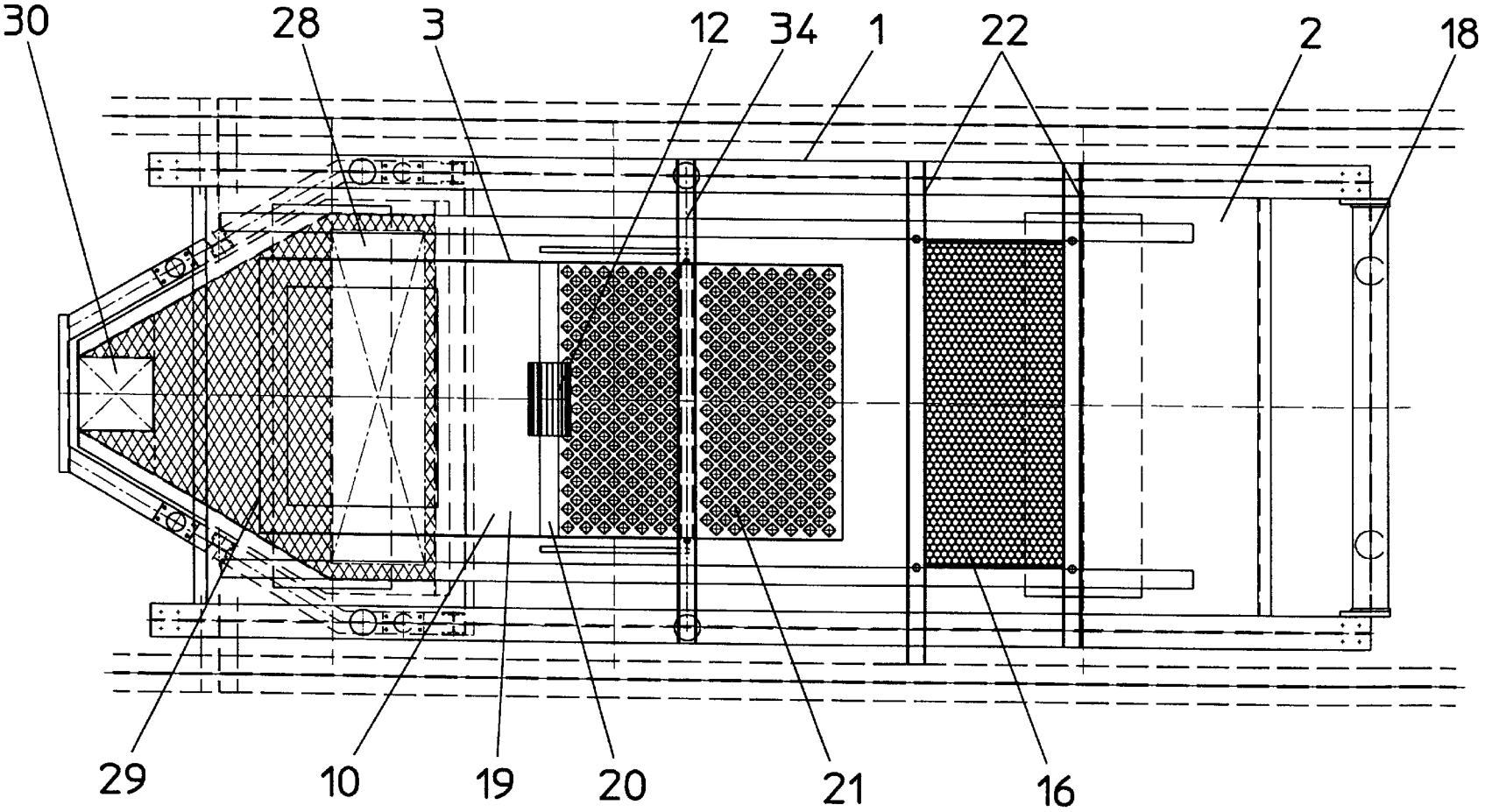
FIG. 2 is a plan view of FIG. 1.
Figure 3:
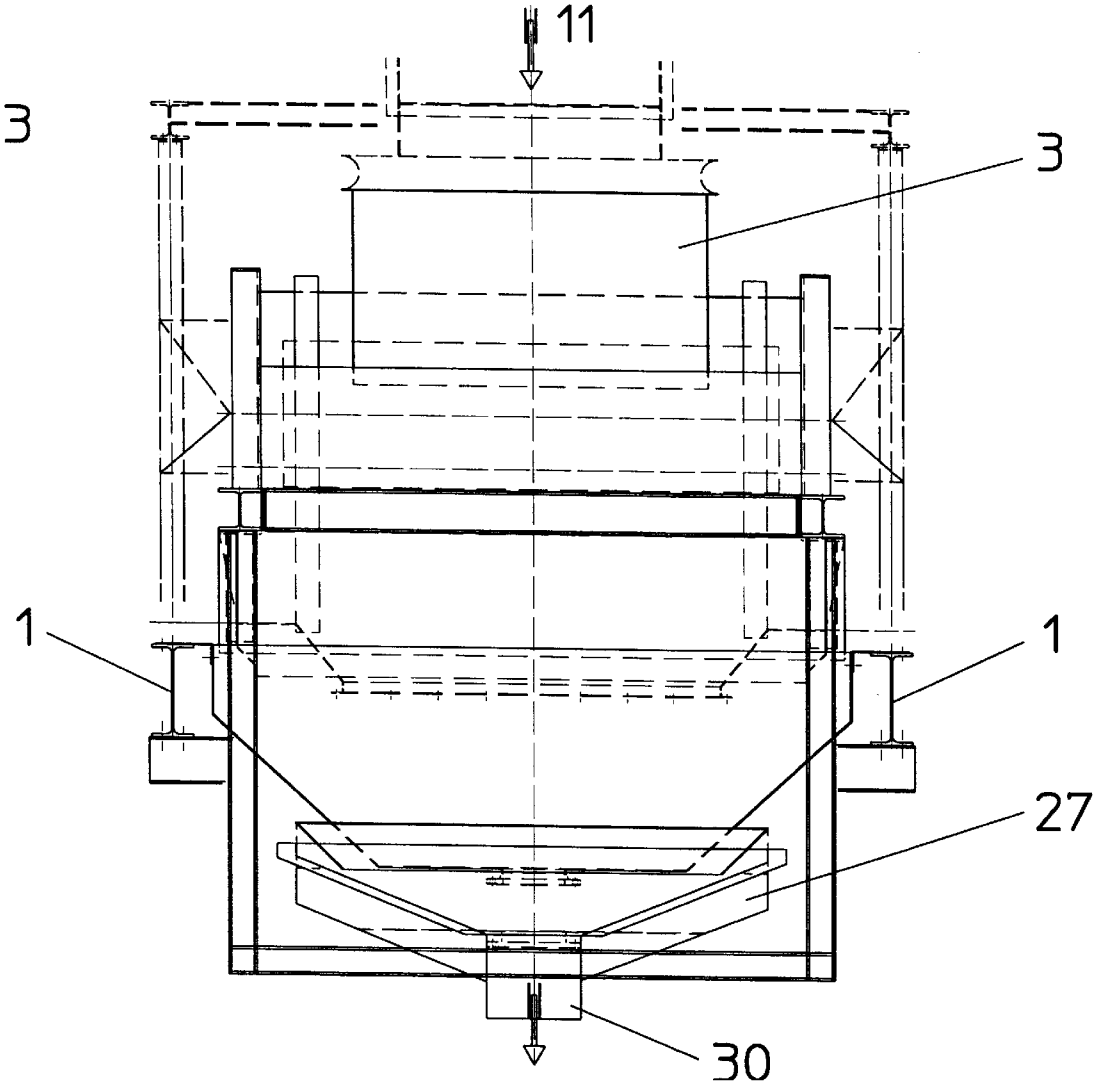
FIG. 3 is a side view of FIG. 1.

Referring now to the drawings and, in particular, FIGS. 1 to 3 there is shown the device according to the invention, which comprises an endless conveyor belt 2 traveling via reversing rollers 9 and supported on guide rollers 7 and support rollers 8. Conveyor belt 2 is designed so that it comprises a rising or elevated part 6 extending to the left, starting from a tension roller arranged in about the middle, and a part 5 extending to the right-hand side. A charging chute 3 is arranged above conveyor belt 2, whereby flow direction 32 of the material charged in material feed area 11 is directed against running direction 31 of conveyor belt 2. Starting from about the area of guide roller 7 and extending to part 5 downstream of charging chute 3, conveyor belt 2 forms a washing trough 4. The components of the device are arranged on a machine frame 1 which can be designed so that it serves as a lateral limitation for conveyor belt 2. Conveyor belt 2 may be limited also as a belt with corrugated edges or by lateral guides.

The cleaned granular solids are discharged on the rising part 6 of conveyor belt 2, whereas the superfine material, i.e., the fine grains and also lightweight harmful substances are discharged on part 5 downstream of charging chute 3. There is a shower device 35 in rising or elevated part 6, which serves for after-washing. The pressure and position of the shower device are adjustable. The granular solids discharged on part 6 are dewatered in a dynamic dewatering device 27, which is mounted on machine frame 1. The material is transported via a charging opening 28 and a dewatering gutter 29 with a slotted screen bottom, to a discharge opening 30.

Dynamic charging chute 3, which is equipped with a vibrating motor 12, has a bottom 10, which is designed within material feed area 11 in the form of a false bottom 19 extending above the inlet of the washing trough, and which is then adjoined by an adjustable gap 20 bordering on false bottom 19. The other area 21 of bottom 10 is perforated. This permits the charged material to drain down into separation bed or washing trough 4 in a defined manner. Furthermore, charging chute 3, within material feed area 11, is vertically adjustable on an axle 34, so that its inclination can be changed. The height and longitudinal direction of chute 3 are adjustable as well.

This design of charging chute 3 prevents a turbulent flow from occurring when the material settles, so that superfine material can be collected on the outlet of part 5 with sizes in the order of magnitude of about 0 to 4 mm.

Figure 6:
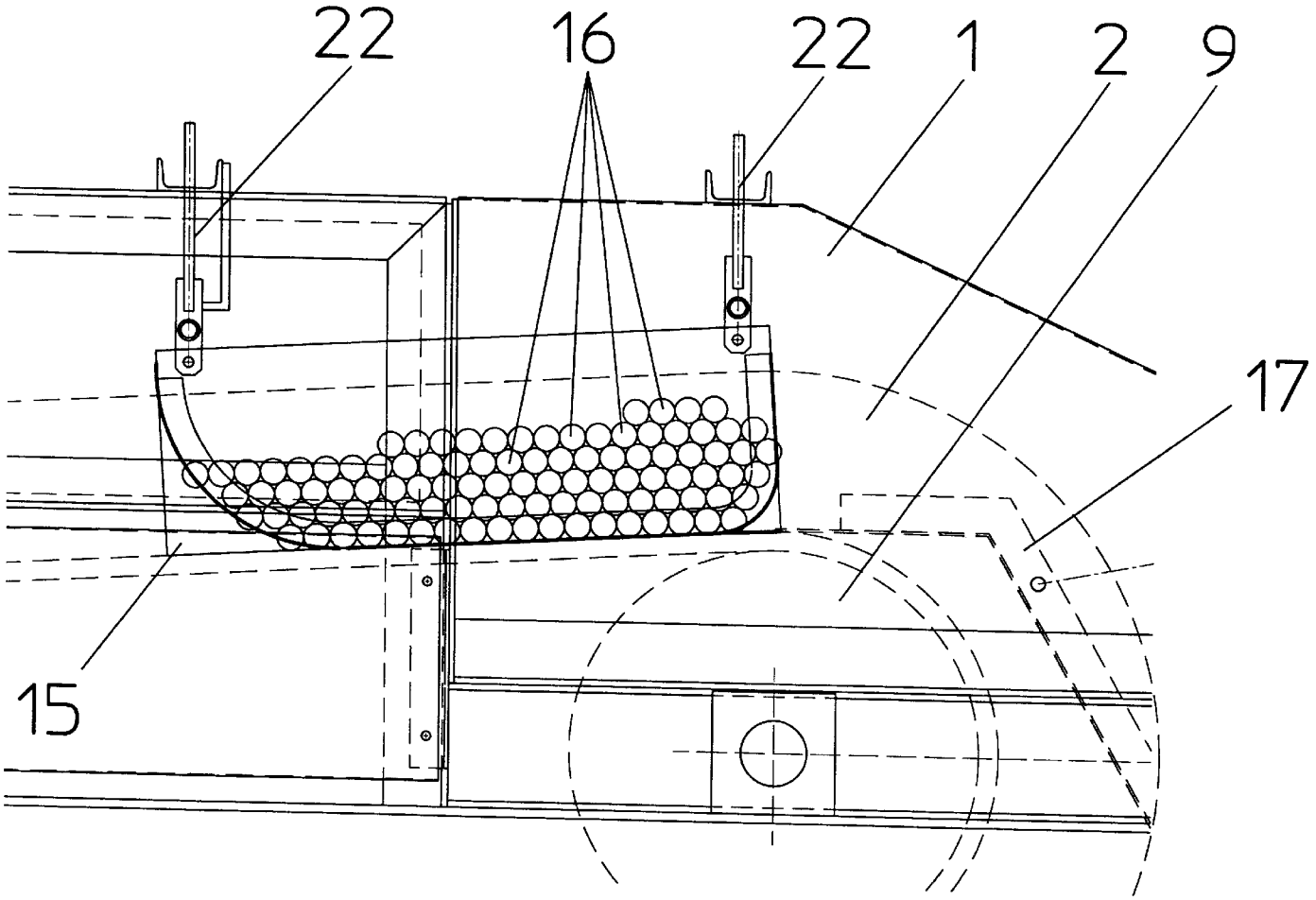
FIG. 6 is an enlarged view of the arrangement of the vat with the spherical elements.
Figure 7:
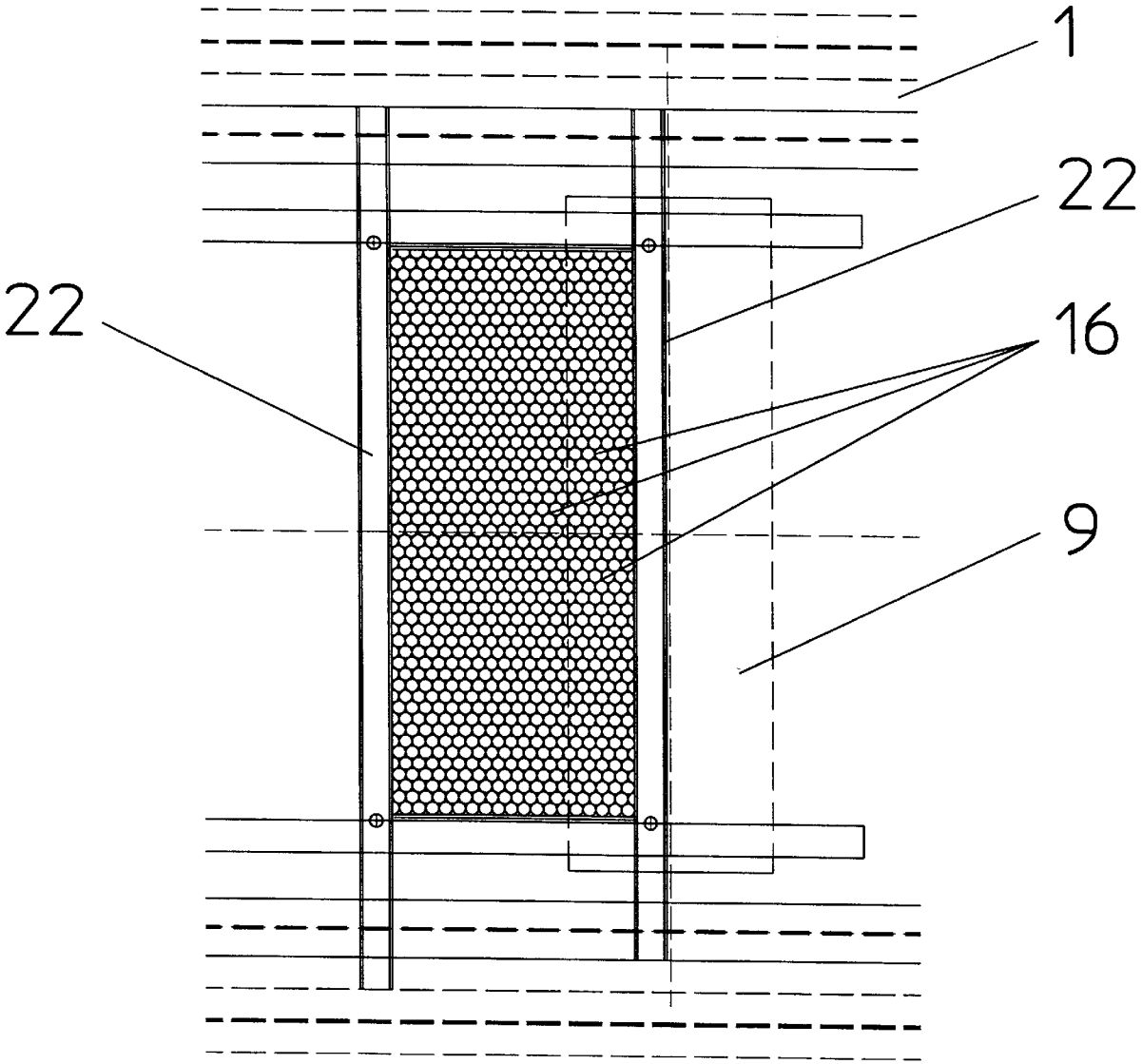
FIG. 7 is a plan view of FIG. 6.
Figure 8:
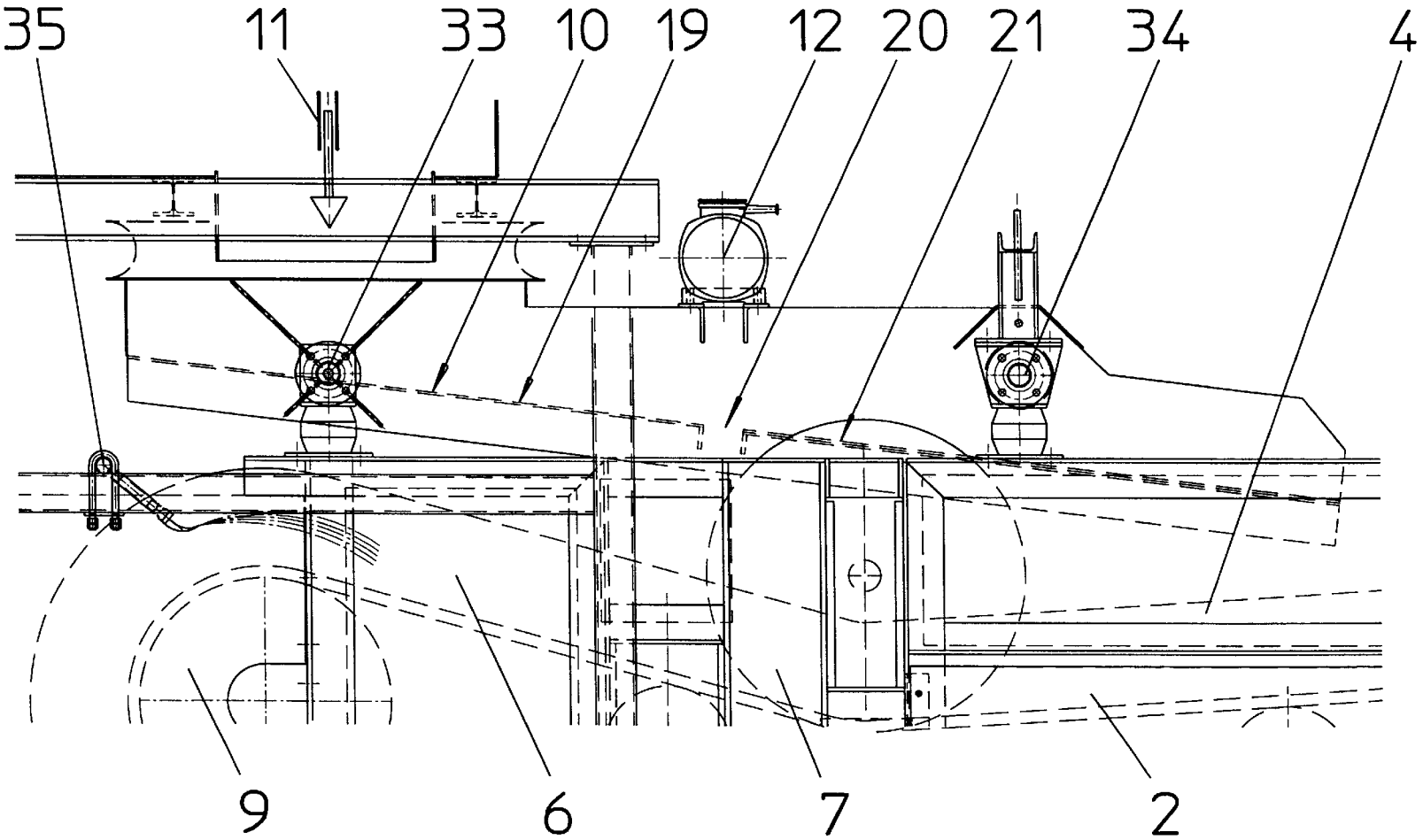
FIG. 8 is an enlarged view of the dynamic charging chute.
Figure 9:
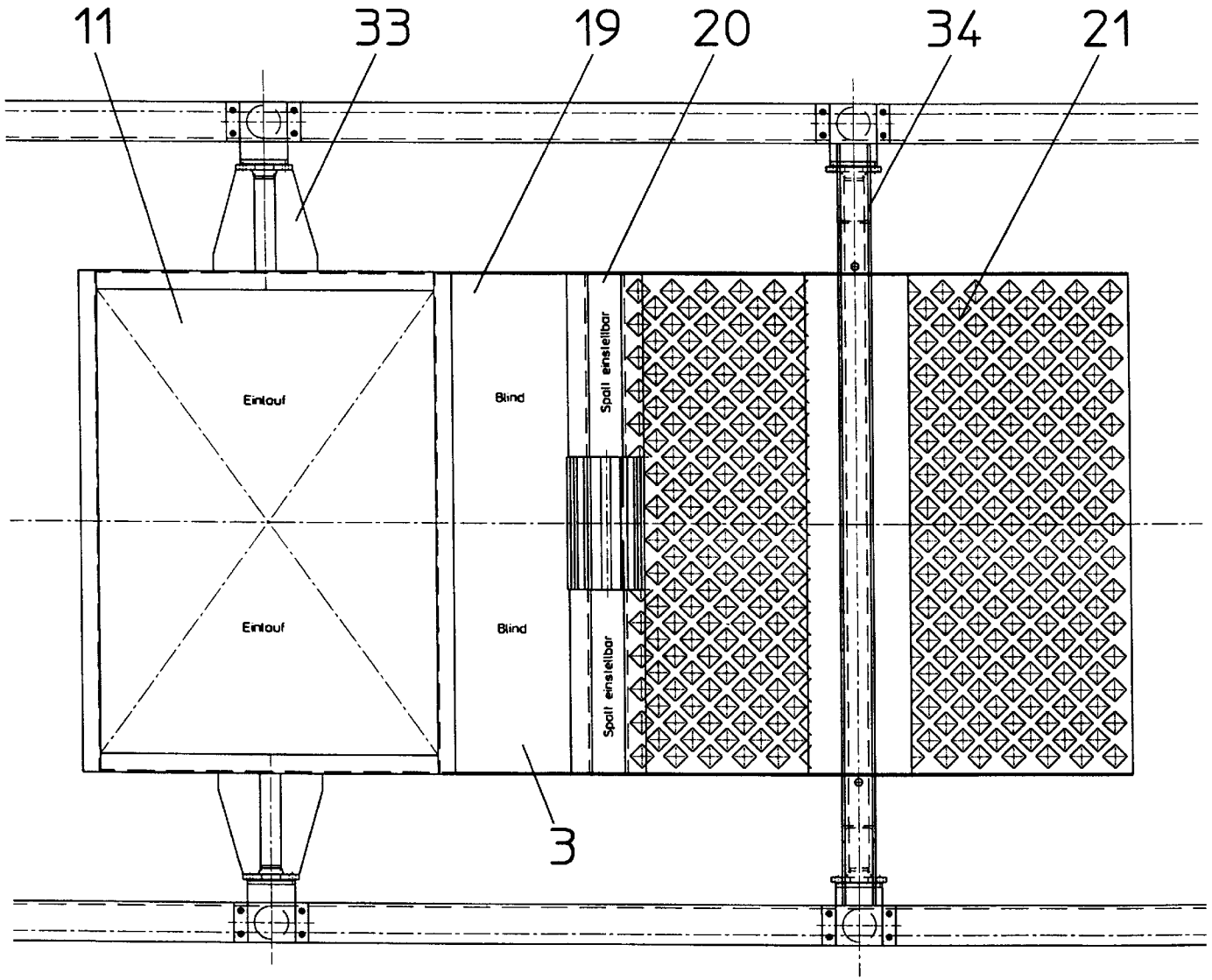
FIG. 9 is a top view of the charging chute according to FIG. 8

This effect is also achievable if a water permeable vat 15 is immersed in the area of part 5 downstream of charging chute 3. This vat is filled with spherical elements 16 and combined with a conventional charging chute. The size of elements 16 affects the separation between the differently sized grains. This separation is also affected by the quality of the surface and the weight of elements 16. The height, incline and longitudinal direction of vat 15 are adjustable via an adjustable suspension 22, as shown in FIG. 6.

A knocking or striking roller 13 is arranged on conveyor belt 2 for enhancing the separation effect.

A separation paddle 17 is mounted in the area of superfine material outlet 18 at the end of part 5 of conveyor belt 2 for dividing the draining suspension in two film or laminar flows. The top flow contains water with light harmful substances and the bottom flow contains water with fine grains.

The device is pivotable on machine frame 1, on the one side around a pivot point 36, and on the other side by a lever system 37. Samples can be automatically collected and evaluated in this way, and a uniform band of grains can be produced by controlling the device as required.

The separation can be enhanced by providing surface 14 of the conveyor belt with a degree of roughness.

Figure 4:
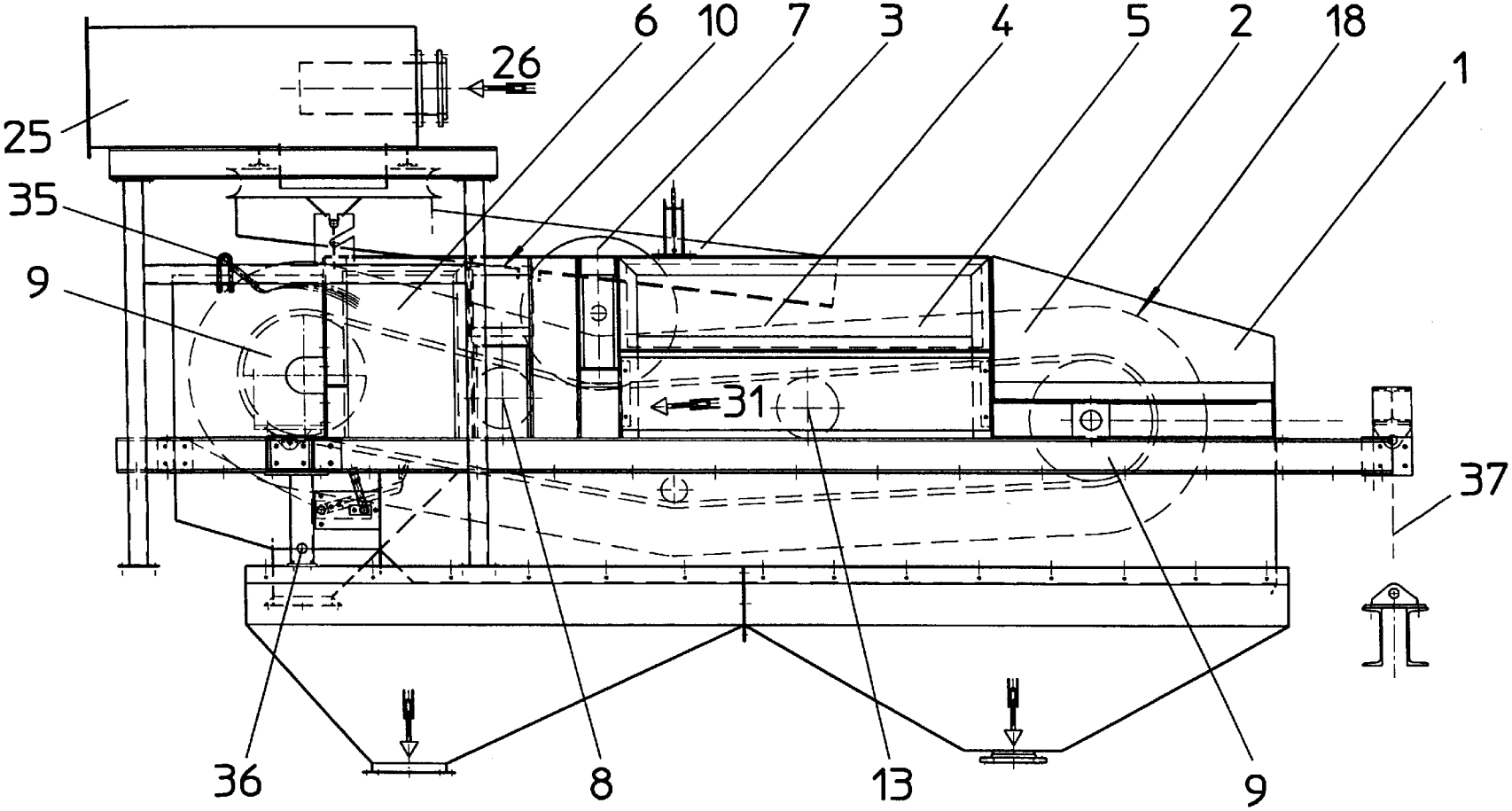
FIG. 4 is an elevation of another embodiment of the device.

In the other embodiment of the device shown in FIG. 4, the material is charged via a baffle or distributor box 25, where the material is fed to charging chute 3 by a pump 26. The material may also be fed by freely dropping it. Charging chute 3 is then a static chute, as no provision has been made in this case for a drive to vibrate the chute.

Figure 5:
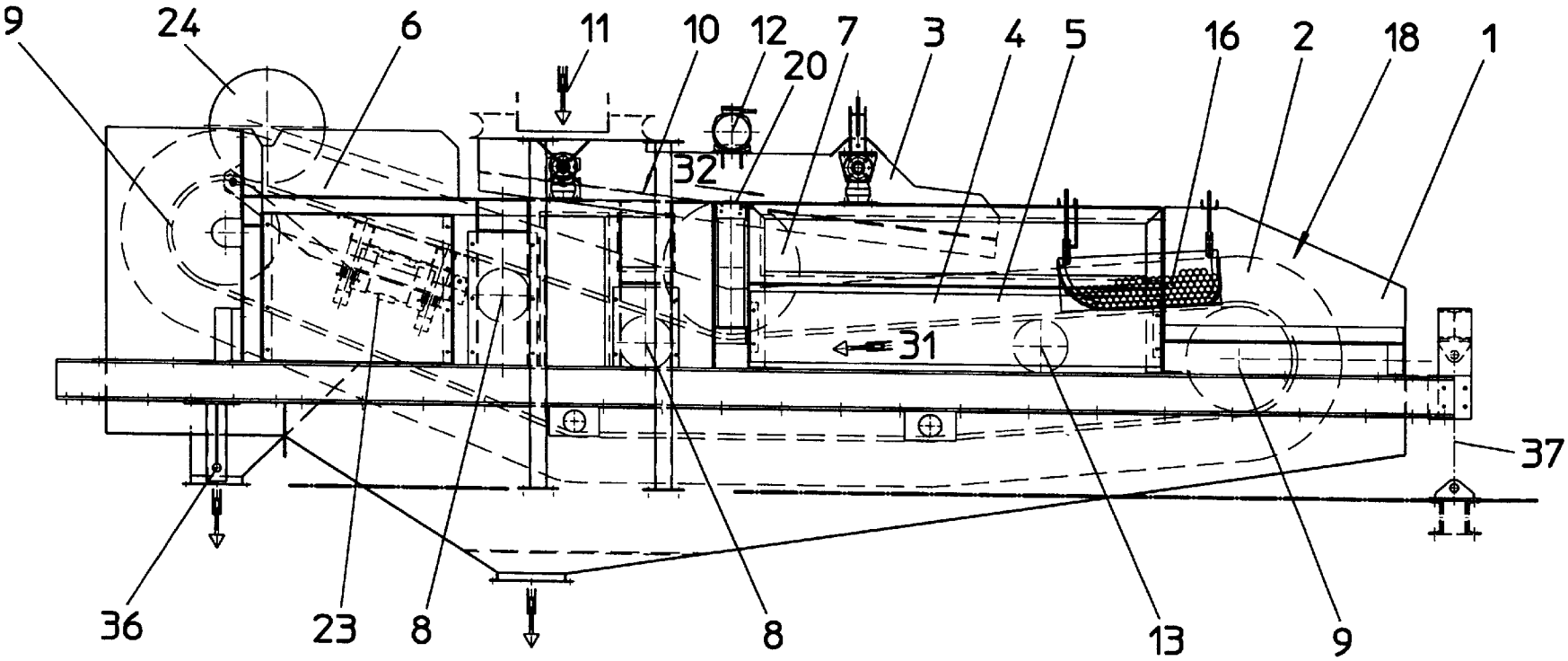
FIG. 5 is an elevation of yet another embodiment of the device.

In the embodiment according to FIG. 5, rising part 6 of conveyor belt 2 is extended in order to obtain enhanced dewatering of the material discharged there by mounting a compactor 23 in that area, and by having a roller 24 applying pressure to the conveyor belt. Roller 24 is suspended in a swinging way and has a dewatering effect on the material to be discharged.

Accordingly, while only a few embodiments of the present invention have been shown and described, it is obvious that many changes and modifications may be made thereunto without departing from the spirit and scope of the invention.

What is claimed is:

1. A device for separating superfine material from continuously fed granular material using a washing liquid, comprising a machine frame;

a charging chute disposed adjacent to the machine frame for feeding the material in a flow direction, said charging chute having a false bottom in a material feed area;

means for showering the separated granular material with the washing liquid;

an endless conveyor belt having support and guide rollers, said rollers being mounted on the machine frame so that part of the conveyor belt is arranged downstream of the charging chute and serves as a washing trough for receiving the material from the charging chute, and another part of the conveyor belt is arranged underneath the charging chute and is inclined against the direction of flow of the material, and wherein the conveyor belt is driven against the direction of flow of the material, wherein the charging chute adjoins the washing trough via a gap extending over the total width of the washing trough, and wherein a remaining part of the bottom of the charging chute is perforated.

2. The device according to claim 1, wherein the height and position of the charging chute relative to the washing trough and the inclination of the charging chute are adjustable.

3. The device according to claim 1 wherein that the charging chute is dynamic, and equipped with a vibrating motor.

4. The device according to claim 1, wherein the charging is chute static.

5. The device according to claim 1, further comprising an adjustable separation paddle for dividing the material into two film flows, said paddle being arranged on a superfine material outlet at an end of the conveyor belt.

6. The device according to claim 1, further comprising at least one knocking roller arranged on the conveyor belt in the area of the washing trough.

7. The device according to claim 1, wherein the conveyor belt has a rough surface.

8. A device for separating superfine material from continuously fed granular material, comprising a machine frame;

a charging chute connected to the machine frame for feeding material in a predetermined direction, said charging chute having a blind bottom in the area of the material feed;

means for showering the separated superfine material with washing liquid;

an endless conveyor belt supported on support rollers and guide rollers, said rollers being mounted on the machine frame in such a way that part of the conveyor belt is arranged downstream of the charging chute and serves as a washing trough for receiving material from the charging chute, and another part of the conveyor belt is arranged underneath the charging chute and rising against the direction of flow of the material, wherein the conveyor belt is driven against the direction of flow of the material;

a vat disposed over the total width and depth of the washing trough, a flow of the liquid passing through said vat; and a plurality of spherical elements filling the vat.

9. The device according to claim 8, wherein the spherical elements are of different sizes and weights and have different surfaces.

10. The device according to claim 8, wherein the height, incline and longitudinal direction of the vat are adjustable.

* * * * *